US007605781B2

(12) United States Patent
Iwami et al.

(10) Patent No.: US 7,605,781 B2
(45) Date of Patent: Oct. 20, 2009

(54) DISPLAY PANEL DRIVING METHOD

(75) Inventors: Takashi Iwami, Yamanashi-ken (JP); Toyohisa Yuasa, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 883 days.

(21) Appl. No.: 10/806,449

(22) Filed: Mar. 23, 2004

(65) Prior Publication Data

US 2004/0207616 A1 Oct. 21, 2004

(30) Foreign Application Priority Data

Apr. 17, 2003 (JP) ..... 2003-112530

(51) Int. Cl.
*G09G 3/10* (2006.01)

(52) U.S. Cl. ..... 345/68; 345/41; 345/60; 345/63; 345/90

(58) Field of Classification Search ..... 345/60–66, 345/41, 67, 68, 90; 315/169.3, 169.4
See application file for complete search history.

(56) References Cited

U.S. PATENT DOCUMENTS

| | | | | |
|---|---|---|---|---|
| 4,612,611 | A * | 9/1986 | Matthes et al. | 363/49 |
| 5,081,400 | A | 1/1992 | Weber et al. | |
| 6,208,084 | B1 * | 3/2001 | Urakabe et al. | 345/60 |
| 6,646,387 | B2 * | 11/2003 | Chae et al. | 315/165 |
| 2003/0001801 | A1 | 1/2003 | Setoguchi et al. | |

FOREIGN PATENT DOCUMENTS

| | | |
|---|---|---|
| EP | 1 065 650 | 1/2001 |
| JP | 07-160218 | 6/1995 |
| JP | 08-123362 | 5/1996 |
| JP | 9-68946 | 3/1997 |
| JP | 2000-155557 | 6/2000 |
| JP | 2000-242223 | 9/2000 |
| JP | 2002-062844 | 2/2002 |
| JP | 2003-015585 | 1/2003 |
| KR | 2001-0007548 | 1/2001 |

* cited by examiner

*Primary Examiner*—Bipin Shalwala
*Assistant Examiner*—Vince E Kovalick
(74) *Attorney, Agent, or Firm*—Drinker Biddle & Reath LLP

(57) ABSTRACT

A display panel driving method that can reduce power consumption in a sustain step is provided. Output terminals of a column electrode drive circuit connected to column electrodes of a display panel sustain a state of high impedance during the period of the sustain step. An X sustain signal is set as a bipolar pulse signal, in each half-cycle of which the commencement time of the rise of the negative pulse is set longer than the completion time of the rise of the positive pulse, and the commencement time of the fall of the positive pulse is set longer the completion time of fall of the negative pulse. Furthermore, a Y sustain signal is displaced by a half cycle from the phase of the X sustain signal. It should be noted that the polarity of these pulses may be reversed.

4 Claims, 8 Drawing Sheets

FIG. 7A VOLTAGE WAVEFORM OF SUSTAIN PULSE SIGNAL FOR X ELECTRODE
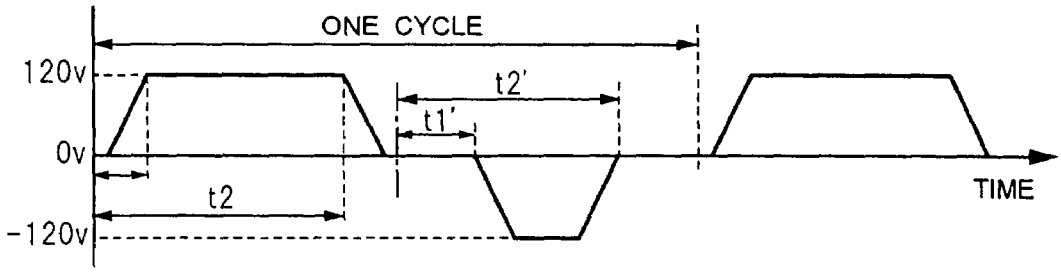
FIG. 7B VOLTAGE WAVEFORM OF SUSTAIN PULSE SIGNAL FOR Y ELECTRODE
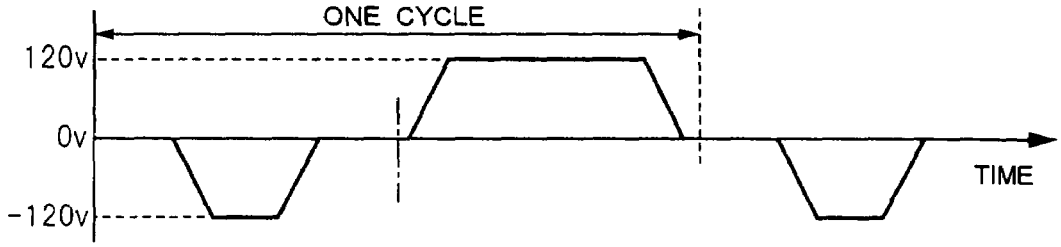
FIG. 7C VOLTAGE WAVEFORM OF (X - Y)
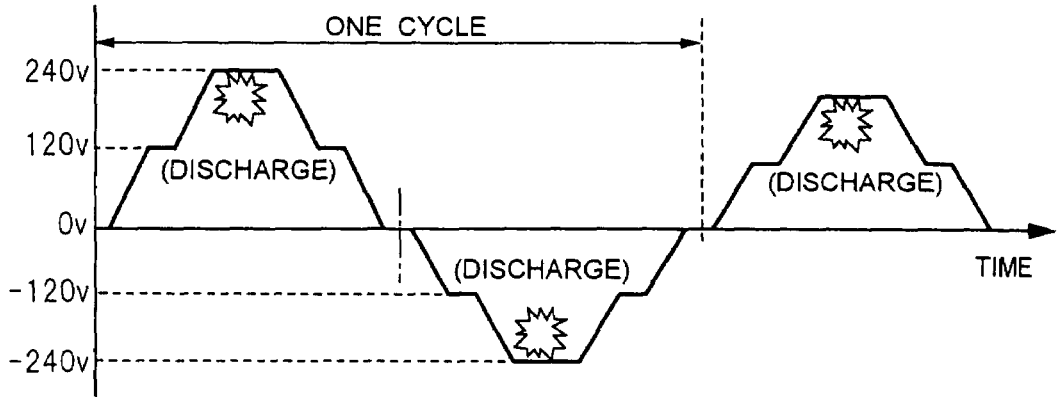
FIG. 7D VOLTAGE WAVEFORM OF (X + Y) / 2
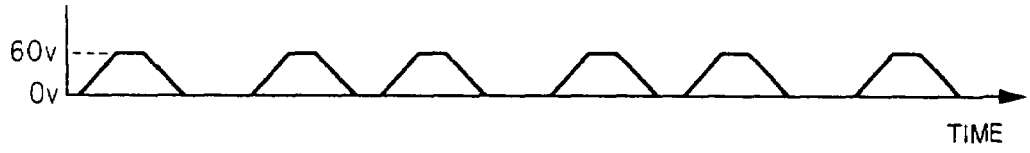

DISPLAY PANEL DRIVING METHOD

BACKGROUND OF THE INVENTION

1. Field of the Invention

The present invention relates to display panel driving methods for driving display panels such as plasma display panels (hereafter, "PDP") and electroluminescence (hereafter, "EL") panels.

2. Description of the Related Art

Display devices that use self-light emitting flat display panels such as PDPs and EL panels are currently being commercialized as so-called wall-mounted TVs. As a display device using a PDP as a display panel, for example there is the art disclosed in Japanese Patent Kokai No. 2000-155557 (Patent Document 1). An overall configuration of the drive circuit in the PDP display device disclosed in Patent Document 1 is shown in the block diagram of FIG. 1.

In FIG. 1, a display panel PDP 10 has row electrodes $X_1$ to $X_n$ and row electrodes $Y_1$ to $Y_n$, which are formed such that each pair of a row electrode X and a row electrode Y constitutes a row electrode pair corresponding to a row (first row to n-th row) of one screen. Furthermore, in the PDP 10, column electrodes $Z_1$ to $Z_m$ are formed perpendicular to the row electrodes, sandwiching a dielectric layer and a discharge space layer, which are not shown in the drawing, and correspond to columns (first column to m-th column) of one screen. It should be noted that a single discharge cell $C_{(i,j)}$ is formed at the intersecting portion of each single pair of row electrodes $(X_i, Y_i)$ and single column electrode $Z_j$.

First, a row electrode drive circuit 30 produces a positive reset pulse $RP_y$ like that shown in FIG. 2, which is simultaneously applied to each of the row electrodes $Y_1$ to $Y_n$. At the same time, a row electrode drive circuit 40 produces a negative reset pulse $RP_x$, which is simultaneously applied to all the row electrodes $X_1$ to $X_n$.

By simultaneously applying the reset pulses $RP_x$ and $RP_y$, a discharge is induced in all the discharge cells of the PDP 10, generating charged particles. Subsequent to the completion of this discharge, a predetermined wall charge is formed uniformly in the dielectric layer of all the discharge cells. This processing step is referred to as a reset step.

After the completion of the reset step, a column electrode drive circuit 20 produces pixel data pulses $DP_1$ to $DP_n$ corresponding to pixel data that corresponds to the first to n-th rows of the screen. The pixel data pulses are then applied successively to the column electrodes $Z_1$ to $Z_m$ as shown in FIG. 2. Meanwhile, the row electrode drive circuit 30 produces negative scan pulses SP corresponding to the timing of the application of the pixel data pulses $DP_1$ to $DP_n$. Then, as shown in FIG. 2, the negative scan pulses are applied successively to the row electrodes $Y_1$ to $Y_n$.

Within the discharge cells of the row electrodes to which the scan pulses SP are applied, a discharge is produced in the discharge cells to which a further positive pixel data pulse DP is simultaneously applied, and most of the wall charge therein is lost. On the other hand, as no discharge is produced in the discharge cells to which a scan pulse SP has been applied but a positive pixel data pulse DP has not been applied, the above-mentioned wall charge remains as it is. At this time, the discharge cells in which the wall charge remains as it is become light-emitting discharge cells, and the discharge cells in which the wall charge is extinguished become non-light-emitting discharge cells. This processing step is referred to as an addressing step.

When the addressing step is completed, the row electrode drive circuit 30 continuously applies positive sustain pulses $IP_Y$ to the row electrodes $Y_1$ to $Y_n$ as shown in FIG. 2. In conjunction with this, the row electrode drive circuit 40 continuously applies positive sustain pulses $IP_X$ to the row electrodes $X_1$ to $X_n$ with a timing that is offset against the timing of the sustain pulses $IP_Y$. During the period in which the sustain pulses $IP_X$ and $IP_Y$ are alternately applied, discharge light emissions are repeated by the light-emitting discharge cells in which the above-mentioned wall charge remains as it is, thus maintaining a light-emitting state. This processing step is referred to as a sustain step.

A drive control circuit 50, as shown in FIG. 1, produces various switching signals based on the timing of the supplied video signal in order for the various drive pulses shown in FIG. 2 to be produced. These switching signals are then supplied to the above-mentioned column electrode drive circuit 20, and the row electrode drive circuits 30 and 40. That is, the column electrode drive circuit 20 and the row electrode drive circuits 30 and 40 produce the drive pulses shown in FIG. 2 in response to the switching signals supplied from the drive control circuit 50.

Furthermore, pulse generating circuits, which generate the various drive pulses such as the reset pulse $RP_Y$ and the sustain pulses $IP_X$ and $IP_Y$, are provided for each row and column electrode inside the above-mentioned electrode drive circuits. It should be noted that all of these pulse generating circuits use the charging and discharging of capacitors in LC resonance circuits made of an inductor L and a capacitor C to generate the various drive pulses.

In other words, the resonance circuits are formed combining inductors, which are inductive elements, and capacitors for power collection exploiting the fact that the discharge cells $C(_{i,\ j})$ of the PDP 10 are capacitive loads. A desired driving pulse is then generated by exciting the resonance circuits with a predetermined timing by opening and closing switching elements such as FETs in response to switching signals supplied from the drive control circuit 50.

In this way, the prior art described above aim to improve power dissipation when driving a display panel by using resonance circuits for the circuits that drive the discharge cells, which constitute capacitive loads. However, generally a comparatively high voltage of around several tens to one hundred and several tens of volts is used when exciting discharge cells with resonance circuits. For this reason, the power dissipation is still large when driving a display panel and there is a need for improved reductions in reactive power.

The present invention has been made to solve such a problem as described above. Examples of the objects to be attained by the present invention include, for example, providing a display panel driving method that can reduce power consumption when exciting discharge cells.

SUMMARY OF THE INVENTION

According to an aspect of the present invention, a display panel driving method for driving a display panel, the display panel including a plurality of row electrode pairs, a plurality of column electrodes arranged intersecting the plurality of row electrode pairs, and capacitive light-emitting elements arranged at an intersecting point of the row electrode pairs and the column electrodes, and in which driving is performed by repeating a driving step that comprises an addressing step and a sustain step, wherein during the period of the sustain step, an output terminal of a column electrode drive circuit connected to one of the row electrodes is maintained in a high impedance state, and bipolar pulse signals with different phases are supplied to each of a first row electrode and a second row electrode that configures each of the row electrode pairs.

BRIEF DESCRIPTION OF THE DRAWINGS

FIG. 7A to FIG. 7D are time charts that show the voltage waveforms of sustain pulse signals according to the present invention.

DETAILED DESCRIPTION OF THE INVENTION

Embodiment of the Invention

Figure 1:
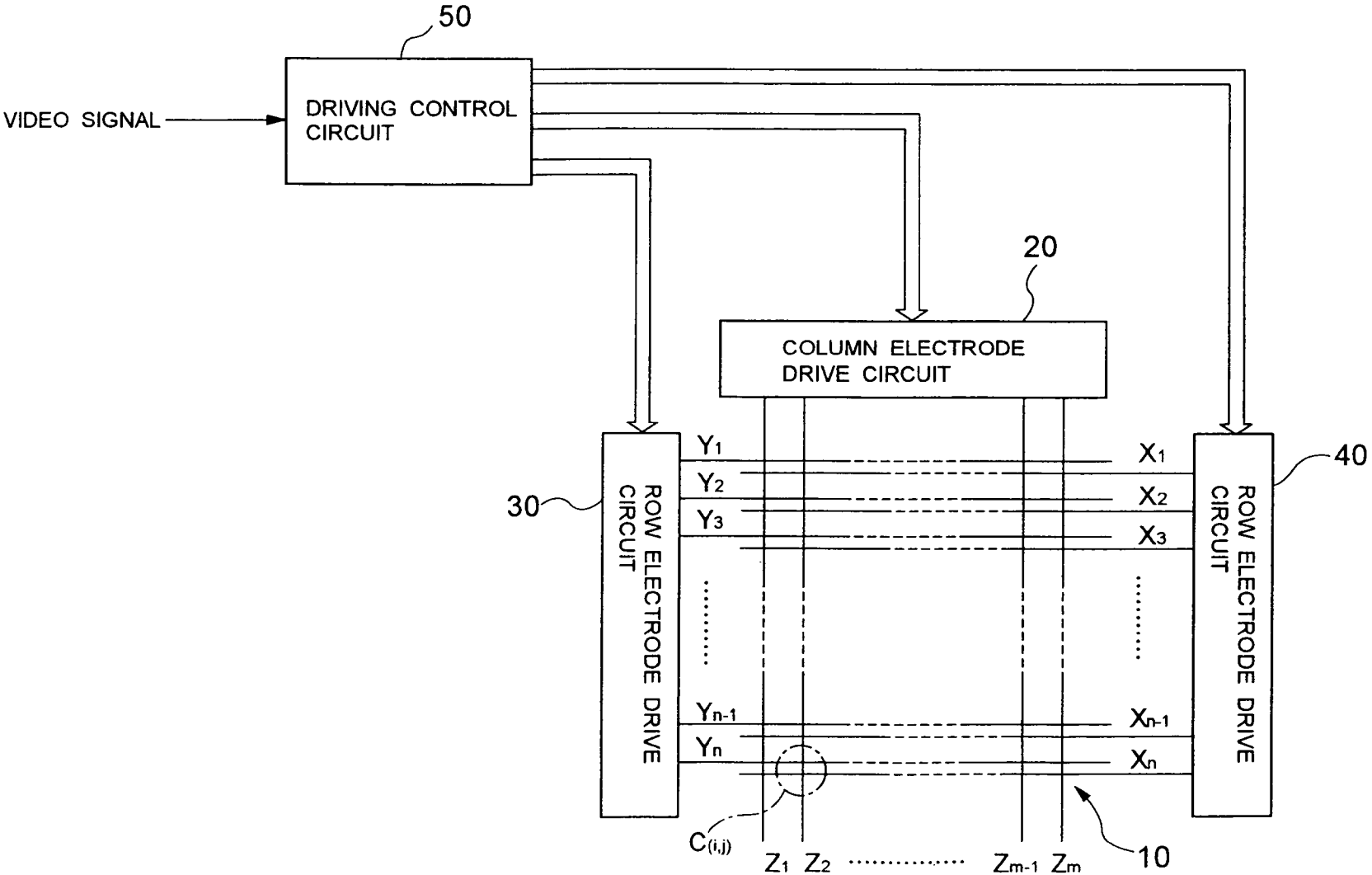
FIG. 1 Prior Art
FIG. 1 is a block diagram of an overall configuration of a conventional PDP display device.
Figure 2:
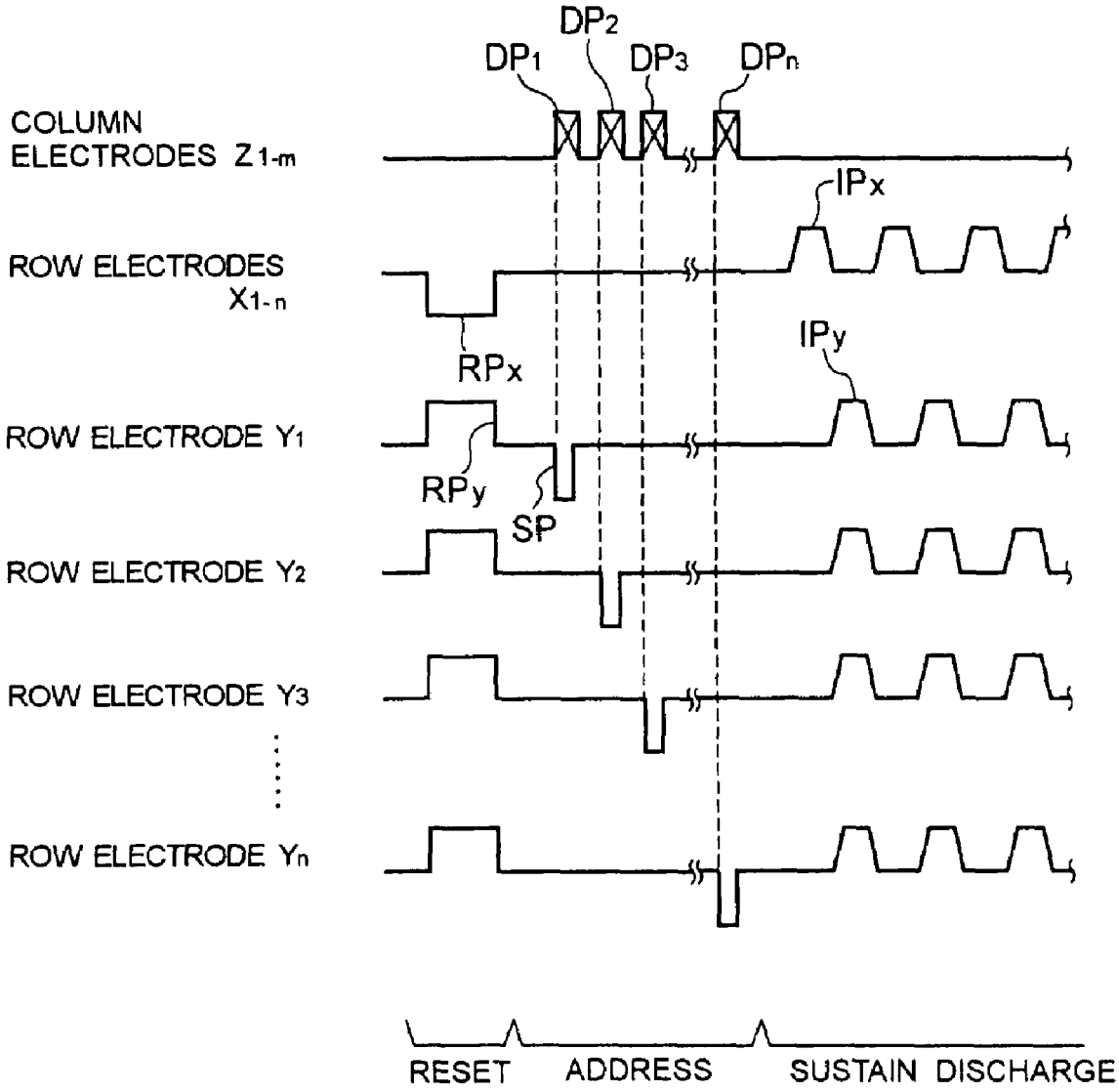
FIG. 2 Prior Art
FIG. 2 is a time chart showing the timing for applying the various driving pulses in the device in FIG. 1.
Figure 3:
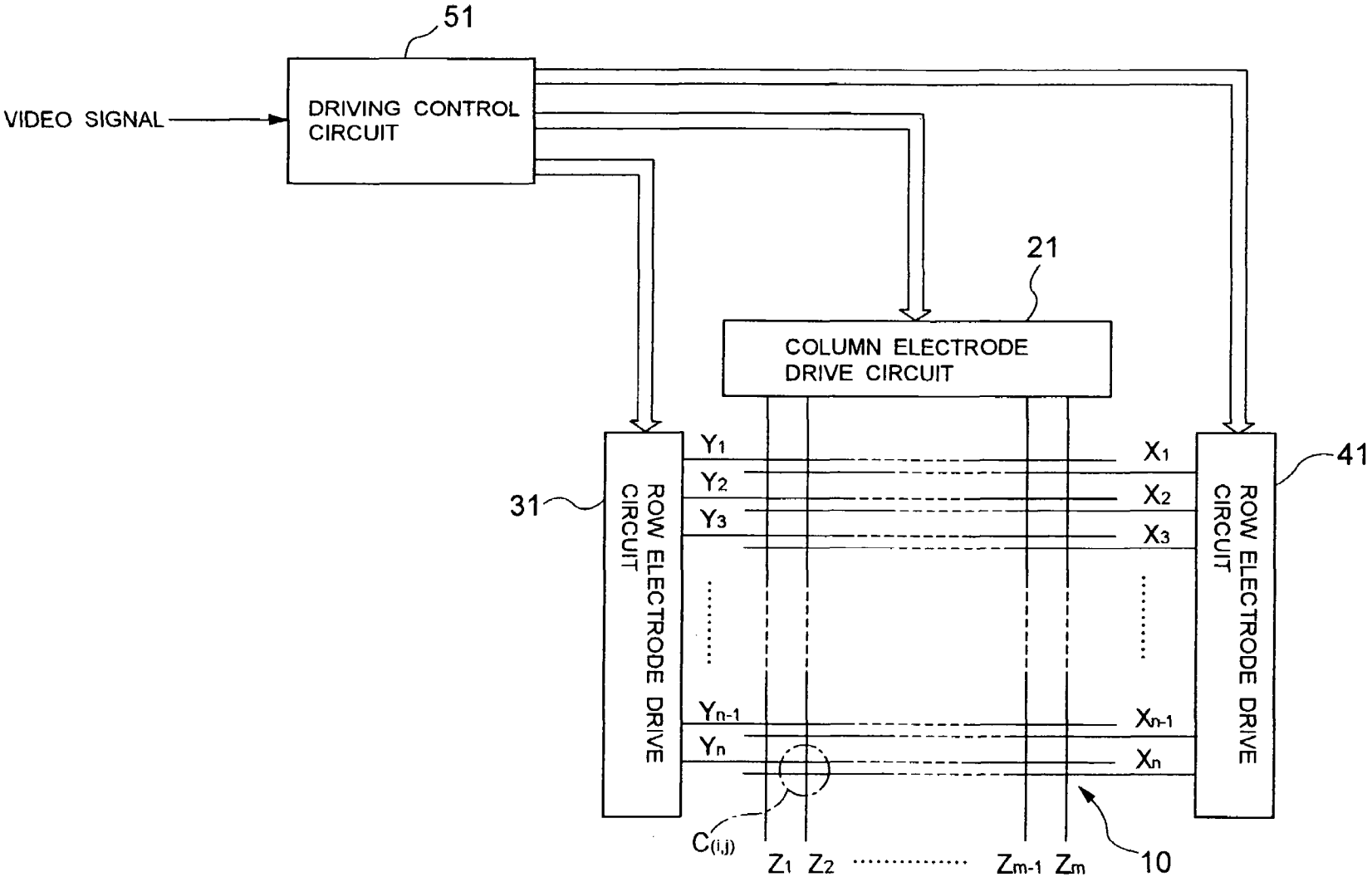
FIG. 3 is a block diagram of an overall configuration of a PDP display device provided with a display panel driving method according to the present invention.

FIG. 3 is a block diagram showing a configuration of a display panel driving device that executes a display panel driving method according to the present invention.

In FIG. 3, a display panel PDP 10 is provided with row electrodes $X_1$ to $X_n$ and row electrodes $Y_1$ to $Y_n$, which are formed such that each pair of a row electrode X and a row electrode Y constitutes a row electrode pair corresponding to a row (first row to n-th row) of one screen. Furthermore, in the PDP 10, column electrodes $Z_1$ to $Z_m$ are formed perpendicular to the row electrodes, sandwiching a dielectric layer and a discharge space layer, which are not shown in the drawing, and correspond to columns (first column to m-th column) of one screen. It should be noted that a single discharge cell $C_{(i,j)}$ is formed at the intersecting portion of each single pair of row electrodes ($X_i$, $Y_i$) and single column electrode $Z_j$.

A row electrode drive circuit 31 produces various drive pulses, such as the above-mentioned reset pulses and sustain pulses, and applies these pulses to the row electrodes $Y_1$ to $Y_n$ with a predetermined timing. Similarly, a row electrode drive circuit 41 also produces various drive pulses and applies these pulses to the row electrodes $X_1$ to $X_n$ with a predetermined timing. Furthermore, a column electrode drive circuit 21 produces pixel data pulses corresponding to pixel data that corresponds to the first to n-th display lines, and these pulses are applied successively to the column electrodes $Z_1$ to $Z_m$.

Furthermore, pulse generating circuits, which generate the various above-mentioned drive pulses, are provided for each row and column electrode inside the row electrode drive circuits 31 and 41, and the column electrode drive circuit 21.

A drive control circuit 51 produces various switching signals based on the supplied video signal in order for the various, above-mentioned drive pulses to be produced. These switching signals are then supplied to the pulse generating circuits that are arranged inside the column electrode drive circuit 21, and the row electrode drive circuits 31 and 41.

Next, a specific configuration of one of the pulse generating circuits that is arranged inside the row electrode drive circuits 31 and 41 and the column electrode drive circuit 21 is described with reference to the circuit diagram shown in FIG. 4.

Figure 4:
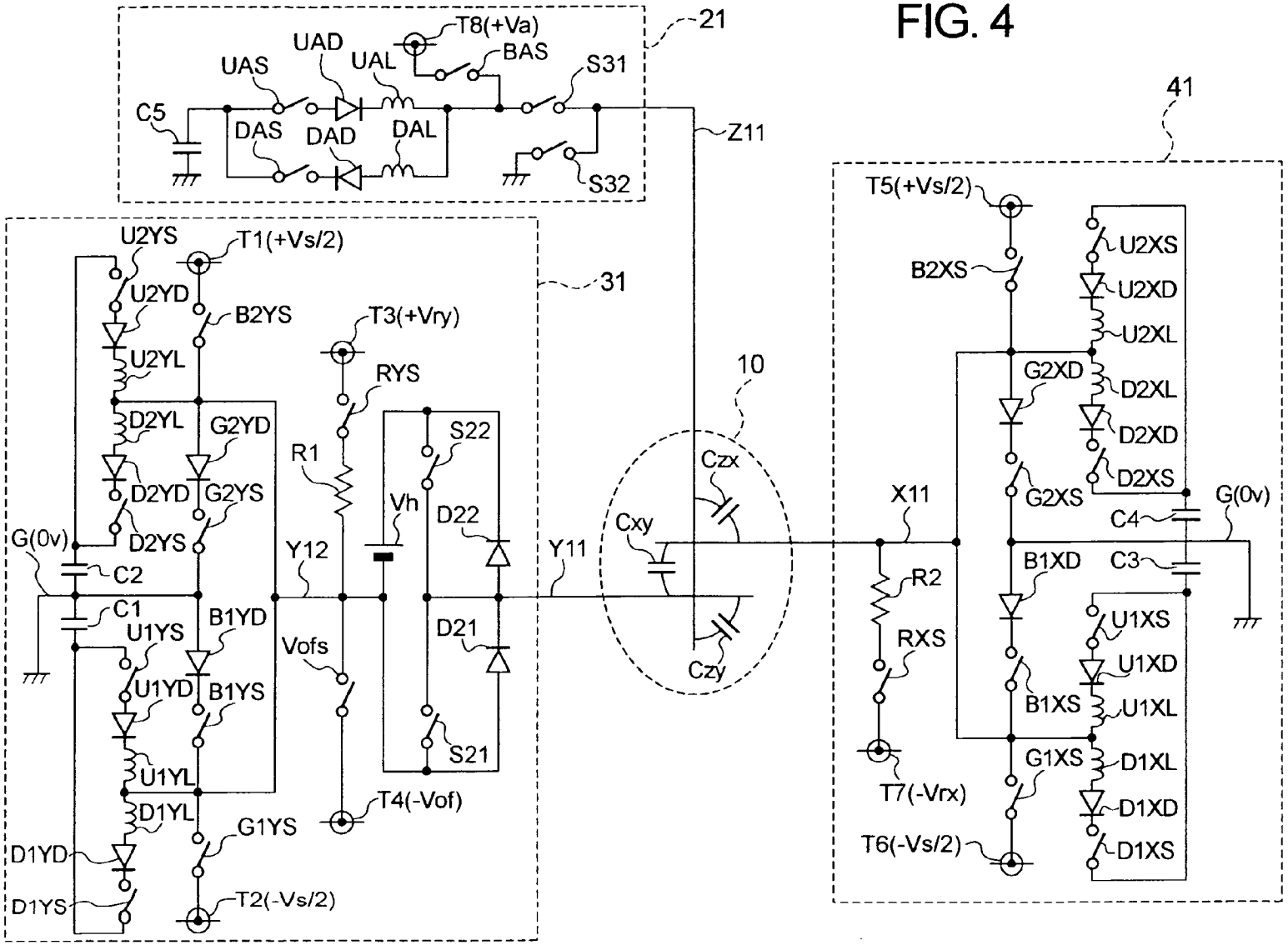
FIG. 4 is a circuit diagram showing a pulse generating circuit executing a display panel driving method according to the present invention.

It should be noted that the circuit shown in FIG. 4 is only an exemplary embodiment of a circuit with which a display panel driving method according to the present invention can be executed, and that the present invention is in no way limited to the circuit configuration of this embodiment. Furthermore, the circuit shown in FIG. 4 demonstrates a configuration of a single discharge cell of the PDP 10, that is, a configuration of a pulse generating circuit involving a single pair of row electrodes and a single column electrode. Accordingly, the pulse generating circuit shown in FIG. 4 is arranged inside each of the row electrode drive circuits 31 and 41 and the column electrode drive circuit 21 for each of the first to n-th row of display lines and for each of the first to m-th columns of one screen.

The configuration of the pulse generating circuit contained in the row electrode drive circuit 31 (Y electrode drive circuit) shown in FIG. 4 is described first.

In FIG. 4, the ground terminal (O V) of an unshown DC power source, which produces DC voltages +Vs/2 and −Vs/2, is connected to a ground potential G (0 V), which is the ground potential of the PDP 10. Also, in this circuit, a positive terminal (+Vs/2) of the DC power source is connected to a power source terminal T1, and a negative terminal (−Vs/2) is connected to a power source terminal T2.

Further, one terminal of a switch B2YS is connected to the power source terminal T1, and the other terminal of the switch B2YS is connected to the anode of a diode G2YD, one terminal each of a serial branch U2Y and a serial branch D2Y, and a connecting line Y12. It should be noted that "serial branch U2Y" refers to a serial circuit made of an inductor U2YL, a diode U2YD, and a switch U2YS. Likewise, "serial branch D2Y" refers to a serial circuit made of an inductor D2YL, a diode D2YD, and a switch D2YS.

On the other hand, both of the other terminals of the serial branch U2Y and the serial branch D2Y are connected to one terminal of a capacitor C2, while the other terminal of the capacitor C2 is connected to the ground G (0 V). Incidentally, the portion made of the serial branch U2Y, the serial branch D2Y, and the capacitor C2 makes up a single resonance circuit in the pulse generating circuit contained in the row electrode drive circuit 31.

On the other hand, the cathode of a diode G2YD is connected to one terminal of a switch G2YS, while the other terminal of the switch G2YS is connected to the anode of a diode B1YD, the other terminal of the above-mentioned capacitor C2, and the ground G (0V).

Furthermore, the cathode of the diode B1YD is connected to one terminal of a switch B1YS, while the other terminal of the switch B1YS is connected to one terminal of a switch G1YS, the connecting line Y12, and one terminal each of a serial branch U1Y and a serial branch D1Y. It should be noted that "serial branch U1Y" refers to a serial circuit made of an inductor U1YL, a diode U1YD, and a switch U1YS. Likewise, "serial branch D1Y" refers to a serial circuit made of an inductor D1YL, a diode D1YD, and a switch D1YS.

Also, both of the other terminals of the serial branch U1Y and the serial branch D1Y are connected to one terminal of a capacitor C1, while the other terminal of the capacitor C1 is connected to the ground G (0 V). Incidentally, the portion made of the serial branch U1Y, the serial branch D1Y, and the capacitor C1 makes up another single resonance circuit in the pulse generating circuit contained in the row electrode drive circuit 31. Furthermore, the other terminal of the switch G1YS is connected to the power source terminal T2 (−Vs/2).

On the other hand, the connecting line Y12 is connected to one terminal of a resistor R1, one terminal of a switch VofS, the cathode of a bias power source Vh, one terminal of a switch S21, and the anode of a diode D21. The other terminal of the resistor R1 is connected via a switch RYS to a power source terminal T3 (+Vry), while the other terminal of the switch VofS is connected to a power source terminal T4 (−Vof). Furthermore, the anode of the power source Vh is connected to one terminal of a switch S22 and the cathode of a diode D22. Additionally, the other terminals of the switch 21 and the switch 22, as well as the cathode of the diode D21 and the anode of the diode D22, are connected to a connecting line Y11. Incidentally, the circuit arranged between the connecting line Y12 and the connecting line Y11 is the portion that generates the reset pulses and the scanning pulses in the reset step and the addressing step.

It should be noted that the connecting line Y11 is an output terminal for the pulse signal that leads to the Y row electrode of the PDP 10, and is therefore connected to the capacitance component of the discharge cell $C_{(i,j)}$ in the PDP 10.

Next, the configuration of the pulse generating circuit contained in the row electrode drive circuit 41 (X electrode drive circuit) shown in FIG. 4 is described.

In FIG. 4, the DC voltage +Vs/2 from the unshown power source circuit is connected to a power source terminal T5, and the DC voltage −Vs/2 is connected to a power source terminal T6. Further, one terminal of a switch B2XS is connected to the power source terminal T5, and the other terminal of the switch B2XS is connected to an anode of a diode G2XD, one terminal each of a serial branch U2X and a serial branch D2X, and the connecting line Y11. It should be noted that "serial branch U2X" refers to a serial circuit made of an inductor U2XL, a diode U2XD, and a switch U2XS. Likewise, "serial branch D2X" refers to a serial circuit made of an inductor D2XL, a diode D2XD, and a switch D2XS.

Both of the other terminals of the serial branch U2X and the serial branch D2X are connected to one terminal of a capacitor C4, while the other terminal of the capacitor C4 is connected to the ground G (0 V). Incidentally, the portion made of the serial branch U2X, the serial branch D2X, and the capacitor C4 makes up a single resonance circuit in the pulse generating circuit contained in the row electrode drive circuit 41.

On the other hand, the cathode of a diode G2XD is connected to one terminal of a switch G2XS, while the other terminal of the switch G2XS is connected to the anode of a diode B1XD, the other terminal of the above-mentioned capacitor C4, and the ground G (0 V).

Furthermore, the cathode of the diode B1XD is connected to one terminal of a switch B1XS, while the other terminal of the switch B1XS is connected to one terminal of a switch G1XS, the connecting line Y11, and one terminal each of a serial branch U1X and a serial branch D1X. It should be noted that "serial branch U1X" refers to a serial circuit made of an inductor U1XL, a diode U1XD, and a switch U1XS. Likewise, "serial branch D1X" refers to a serial circuit made of an inductor D1XL, a diode D1XD, and a switch D1XS.

Both of the other terminals of the serial branch U1X and the serial branch D1X are connected to one terminal of a capacitor C3, while the other terminal of the capacitor C3 is connected to the ground G (0 V). Incidentally, the portion made of the serial branch U1X, the serial branch D1X, and the capacitor C3 makes up another single resonance circuit in the pulse generating circuit contained in the row electrode drive circuit 41. Furthermore, the other terminal of the switch G1XS is connected to the power source terminal T6 (−Vs/2).

On the other hand, the connecting line X11 is connected to one terminal of a resistor R2, and the other terminal of the resistor R2 is connected via a switch RXS to a power source terminal T7 (+Vrx). Moreover, the connecting line Y11 is an output terminal for the pulse signal that leads to the X row electrode of the PDP 10, and is therefore connected to the capacitance component of the discharge cell $C_{(i,j)}$ in the PDP 10.

Next, the configuration of the pulse generating circuit contained in the column electrode drive circuit 21 (Z electrode drive circuit) shown in FIG. 4 is described.

In FIG. 4, a DC voltage +Va from an unshown power source circuit is connected to a power source terminal T8, and is also connected to one terminal of a switch BAS.

On the other hand, the other terminal of the switch BAS is connected to one terminal each of a serial branch UA and a serial branch DA, and to one terminal of a switch S31. It should be noted that "serial branch UA" refers to a serial circuit made of an inductor UAL, a diode UAD, and a switch UAS. Likewise, "serial branch DA" refers to a serial circuit made of an inductor DAL, a diode DAD, and a switch DAS.

Additionally, both of the other terminals of the serial branch UA and the serial branch DA are connected to one terminal of a capacitor C5, while the other terminal of the capacitor C5 is connected to the ground G (0 V). Incidentally, the portion made of the serial branch UA, the serial branch DA, and the capacitor C5 makes up a single resonance circuit in the pulse generating circuit contained in the column electrode drive circuit 21.

On the other hand, the other terminal of the switch S31 is connected to one end of a switch S32 and to a connecting line Z11, while the other terminal of the switch S32 is connected to the ground G (0 V). Moreover, the connecting line Z11 is an output terminal for the pulse signal that leads to the column electrode (Z electrode) of the PDP 10, and is therefore connected to the capacitance component of the discharge cell $C_{(i,j)}$ in the PDP 10.

Next, a display panel driving method according to the present invention is described.

First, column electrode (Z electrode) processing during the period of the sustain step, which is a first aspect of the present invention, is described.

Figure 5:
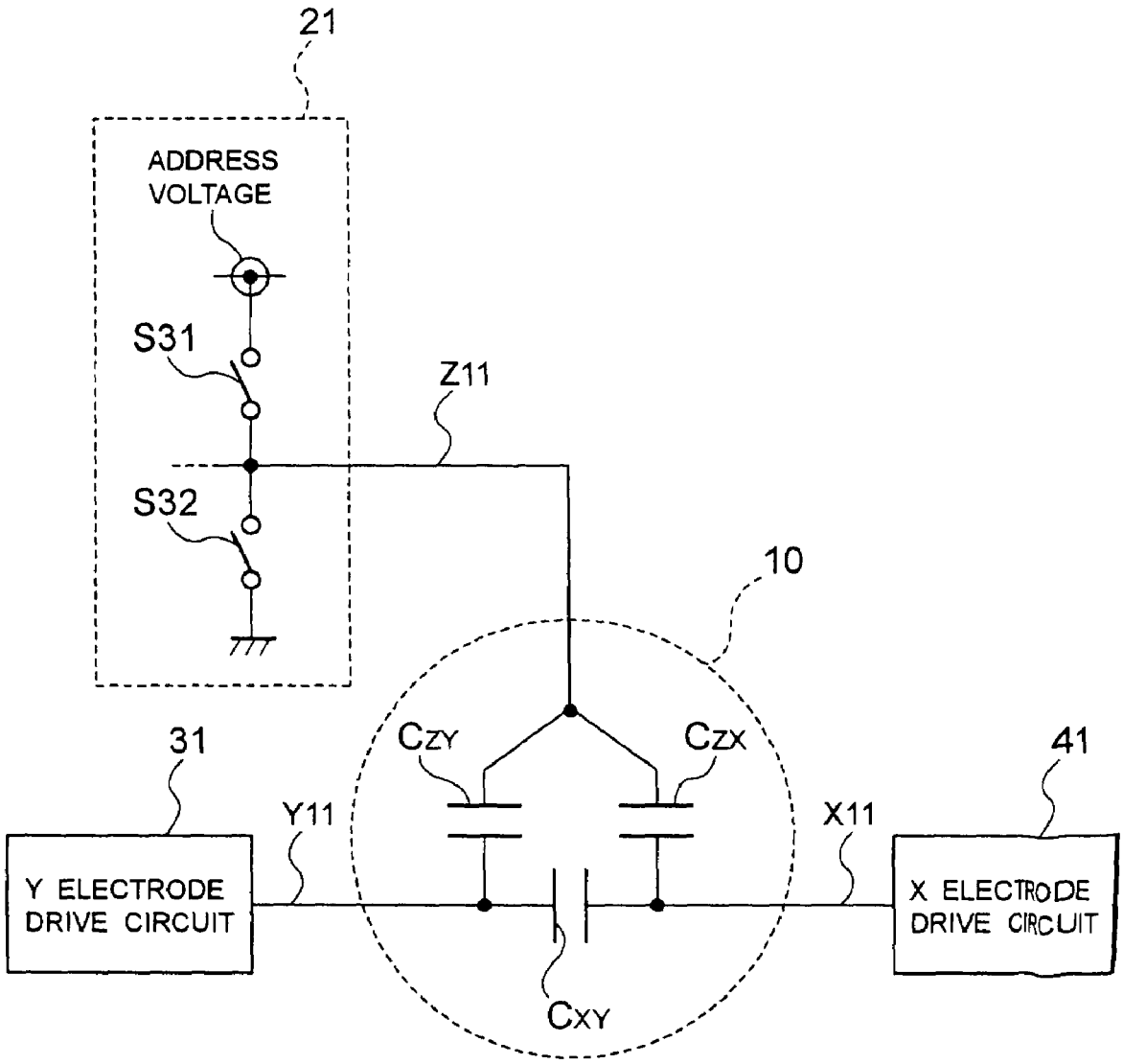
FIG. 5 is a circuit configuration drawing that centers on the discharge cell of the PDP 10 shown in FIG. 4.

A circuit configuration drawing is shown in FIG. 5 that centers on the discharge cell of the circuit shown in the above-described FIG. 4. In FIG. 5, Y11 is the connecting line from the row electrode drive circuit 31 to the Y electrode of the discharge cell of the PDP 10, which at the same time means that it is the output terminal from the row electrode drive circuit 31 to the Y electrode. Likewise, X11 and Z11 represent the output terminals from the row electrode drive circuit 41 and the column electrode drive circuit 21 to the X electrode and the Z electrode of the discharge cell.

It should be noted that, in the discharge cell of the PDP 10 shown in FIG. 5, the capacitance components formed between the X electrode and the Y electrode, the Y electrode and the Z electrode, and the X electrode and the Z electrode are respectively specified as $C_{xy}$, $C_{ZY}$, and $C_{ZX}$.

In a conventional drive circuit, since the Z electrode of the discharge cell is connected to the ground potential during the period of the sustain step, the switch 31 of the column electrode drive circuit 21 has been set to OFF and the switch S32 has been set to ON. Accordingly, when the combined capacitance between X11 and Y11 during this period is given as C1, the value of C1 can be expressed as follows:

$$C1=C_{XY}+C_{ZY}\ (\text{or } C_{XY}+C_{ZX})$$

However, during the period of the sustain step, sustain pulse signals are applied to the X electrode and the Y electrode, and the discharge cell is excited by the resonance circuit contained in each drive circuit. Accordingly, the smaller the discharge cell load capacitance at this time, that is, the smaller the value of the above-mentioned C1, the smaller the power dissipation during excitation.

In focusing on this point, a characteristic of the present invention is that the switches S31 and S32 of the column electrode drive circuit 21 are both set to OFF during the period of the sustain step and Z11 maintains a high impedance, thus putting the Z electrode connected to Z11 in an electrically floating state. In other words, when the combined capacitance between X11 and Y11 is given as C2 according to the present invention, C2 is a parallel circuit of the serial branches $C_{ZY}$ and $C_{ZX}$, and $C_{XY}$. Therefore, C2 can be expressed as:

$$C2=C_{XY}+\{(C_{ZY}\times C_{ZX})/(C_{ZY}+C_{ZX})\}$$

When it is assumed here that:

$$C_{ZY}=C_{ZX}$$

The above equation becomes:

$$C2=C_{XY}+C_{ZY}/2$$

And it becomes evident that the combined capacitance C2 in the embodiment of the present invention is clearly smaller compared to the combined capacitance C1 in the case of conventional technologies.

When assuming specific capacitance components between the electrodes of the discharge cell, for example:

$$C_{XY}=80.7\ \text{pF/line}$$

$$C_{ZY}=78.5\ \text{pF/line}$$

$$C_{ZX}=78.5\ \text{pF/line}$$

The following results are obtained with the above-described equations:

$$C1=154.2\ \text{pF/line}$$

$$C2=117.5\ \text{pF/line}$$

In other words, by putting the column electrode into a floating state during the period of the sustain step in the above-described example, the load capacitance of the discharge cell can be reduced by approximately 20%. Power collection is performed with resonance as in an ordinary sustain step, and assuming that the resonance time and the resistance component of the resonance path are constant, the load capacitance is reduced by 20%, so that it is possible to reduce power consumption by approximately 35%.

Next, a method for supplying sustain pulses to the X electrode and the Y electrode during the period of the sustain step, which is a second aspect of the present invention, is described.

Figure 6:
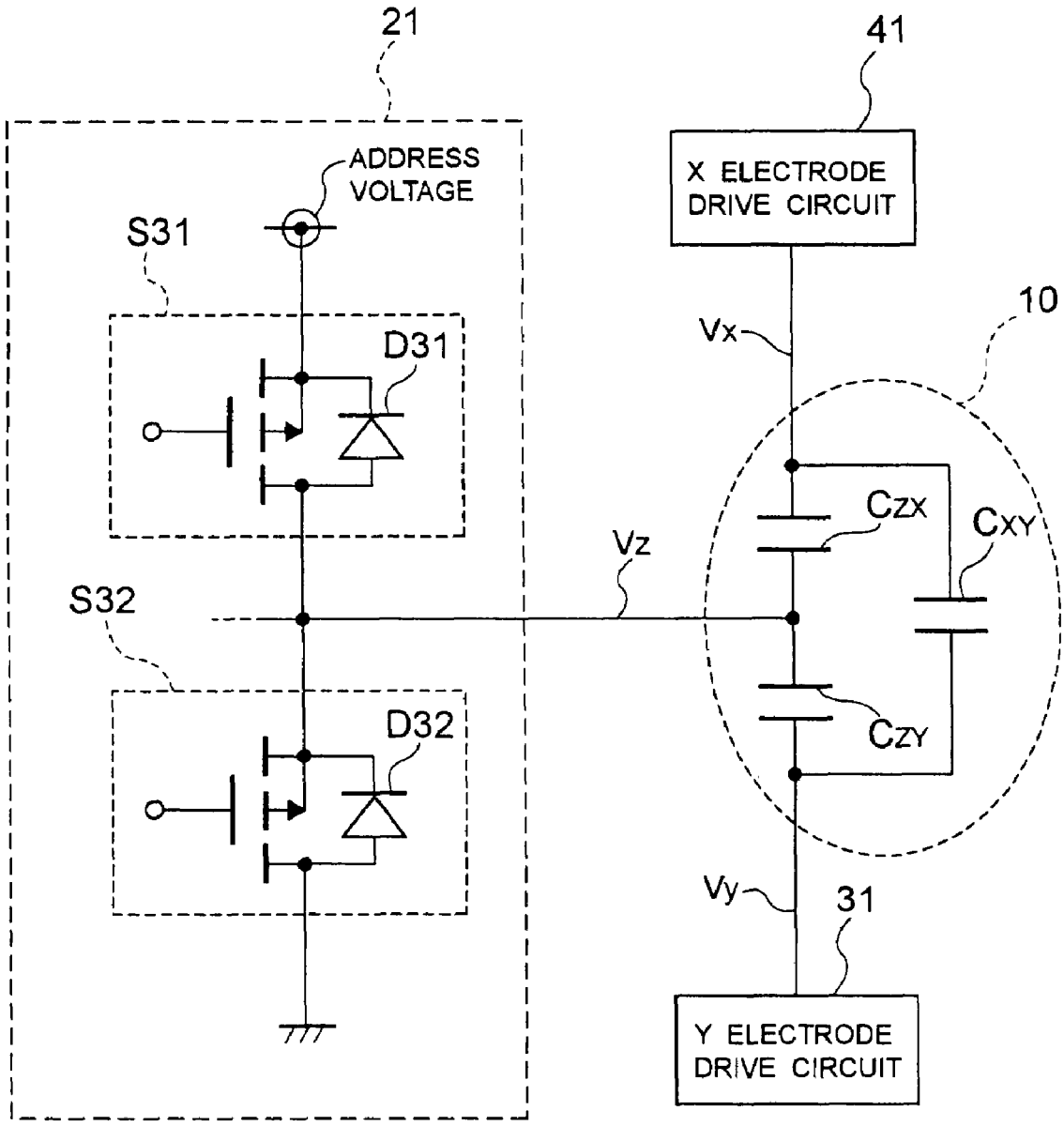
FIG. 6 is a circuit configuration drawing that centers on the output portion of the row electrode drive circuit 21 shown in FIG. 4.

The switches S31 and S32 of the column electrode drive circuit 21 shown in FIG. 5 are commonly configured using semiconductor elements such as FETs. Since a parasitic diode is formed between the drain and source when using a FET, diodes D31 and D32 are parallel connected to the switches S31 and S32 as shown in FIG. 6.

With conventional driving methods, the voltage of the sustain pulse applied to the X electrode and the Y electrode during the period of the sustain step reaches the vicinity of two hundred and several tens of volts. On the other hand, as evident in FIG. 6, the voltage Vz of the Z electrode is the voltage Vx of the X electrode and the voltage Vy of the Y electrode divided by the inter-electrode capacitance components $C_{ZY}$ and $C_{ZX}$ of. And in consideration of the above-described condition that $C_{ZY}=C_{ZX}$, the value of Vz is the mean voltage of Vx and Vy, and can be expressed as follows:

$$Vz=(Vx+Vy)/2$$

In other words, during the period of the sustain step with a conventional driving method, a voltage in the vicinity of one hundred and several tens of volts is apparent at the Z electrode due to the voltage of the sustain pulses applied to the X electrode and the Y electrode.

On the other hand, the set value of the power source voltage (hereafter referred to as "address voltage") contained in the column electrode drive circuit 21 is generally around 60 V, which is very low compared to Vz, which is the mean voltage of Vx and Vy. Therefore, during the period of the sustain step, the parasitic diode of the FET accommodated in the column electrode drive circuit 21 is clamped at the point when the value of Vz exceeds approximately 60 V. Incidentally, the point when the value of Vz exceeds approximately 60 V is when the voltage value of the sustain pulses applied to the X electrode and the Y electrode exceeds approximately 120 V, which means that the excitation of the discharge cell is still at a midpoint stage.

In regard to this, the reduction in load capacitance during excitation of the discharge cell, which was described above as a first aspect of the present invention, first becomes possible by maintaining the output terminal Z11 to the Z electrode at a fully high impedance state. Therefore, if the parasitic diode of the column electrode drive circuit 21 is clamped during sustain resonance and it is difficult to maintain the high impedance state of the output terminal Z11, the basic principle of the power reduction cannot be accomplished.

For this reason, in the embodiment of the present invention, by devising the sustain pulse signals applied to the X electrode and the Y electrode as the voltage waveforms shown in FIGS. 7A to 7D, and preventing the clamping of the above-described parasitic diode, the output terminal to the Z electrode is maintained in a high impedance state. The embodiment of the present invention will be further described below with reference to the time charts in FIGS. 7A to 7D.

First, the voltage waveform of the sustain pulse signal applied to the X electrode (hereafter referred to as "X sustain signal") is shown in FIG. 7A. As shown in FIG. 7A, one cycle of the X sustain signal is made of a half cycle that contains a positive pulse and a half cycle that contains a negative pulse. In each of these half cycles, the time t1' of the commencement of the rise of the negative pulse is set longer than the time t1 of the completion of the rise of the positive pulse. Furthermore, the time t2 of the commencement of the fall of the positive pulse is set longer than the time t2' of the completion of the fall of the negative pulse. It should be noted that in FIG. 7A, the pulse width of the positive pulse is set wider than the pulse width of the negative pulse, but it is also possible to set the polarities of both pulses in reverse.

On the other hand, the voltage waveform of the sustain pulse signal applied to the Y electrode (hereafter referred to as "Y sustain signal") is shown in FIG. 7B. As shown in FIG. 7B, the Y sustain signal is displaced by a half cycle from the phase of the X sustain signal.

X sustain signals and Y sustain signals are applied to the X electrode and the Y electrode of the discharge cell during the period of the sustain step, and therefore the change in the electric potential difference between the X electrode and the Y electrode, that is, the voltage change of (X−Y) gives the voltage waveform shown in FIG. 7C. As evident in FIG. 7C, the peak value of the electric potential difference between the X electrode and the Y electrode for each half cycle of the X and Y sustain signals reaches two hundred and several tens of volts, which is necessary for a sustain discharge, and a sustain discharge is induced in the discharge cell for each peak value.

As mentioned above, the voltage of the Z electrode during the period of the sustain step is (X+Y)/2, which is the mean of the voltages of the X electrode and the Y electrode, and therefore the voltage of the Z electrode corresponding to the X or Y sustain signal gives the voltage waveform shown in FIG. 7D. As evident in FIG. 7D, the voltage of the Z electrode is kept at 60 V or less even at its peak value, and it is possible to prevent clamping of the parasitic diode of the FET accommodated in the row electrode drive circuit 21. In other words, by supplying X and Y sustain signals to the X electrode and the Y electrode in accordance with this embodiment, it is possible to maintain the Z electrode in a floating state without affecting the sustain discharge, thus achieving a reduction in the load capacitance during the driving of sustain resonance.

Accordingly, an embodiment of the instant application involves a display panel driving method for driving a display panel. The display panel includes a plurality of row electrode pairs, a plurality of column electrodes arranged intersecting the plurality of row electrode pairs, and capacitive light-emitting elements arranged at intersecting points of the row electrode pairs and the column electrodes, and in which driving is performed by repeating a driving step that comprises a reset step, an addressing step, and a sustain step. An output terminal of a column electrode drive circuit connected to the column electrodes is connected to a switch having a parasitic diode, and during the period of the sustain step, said output terminal of said column electrode drive circuit is maintained in a high impedance state, and bipolar pulse signals which are a half cycle out of phase with each other are supplied to each of a first row electrode and a second row electrode that constitute each of the row electrode pairs, wherein a period exists wherein a negative polarity pulse and a positive polarity pulse respectively of said bipolar pulse signals are simultaneously applied to one electrode and the other electrode of each of said row electrode pairs respectively, and wherein a leading edge of said negative polarity pulse applied to said one electrode and a leading edge of said positive polarity pulse applied to said other electrode exist at different timings, and a trailing edge of said negative polarity pulse applied to said one electrode and a trailing edge of said positive polarity pulse applied to said other electrode exist at different timings.

Also, an embodiment of the instant application involves a display panel driving method for driving a display panel. The display panel includes a plurality of row electrode pairs, a plurality of column electrodes arranged intersecting the plurality of row electrode pairs, and capacitive light-emitting elements arranged at intersecting points of the row electrode pairs and the column electrodes, and in which driving is performed by repeating a driving step that comprises a reset step, an addressing step, and a sustain step. During the period of the sustain step, an output terminal of a column electrode drive circuit connected to the row electrodes is maintained in a high impedance state, and bipolar pulse signals which are a half cycle out of phase with each other are supplied to each of a first row electrode and a second row electrode that constitute each of the row electrode pairs, wherein said period of said sustain step includes a first section in which a potential of one electrode of each of said electrode pairs transfers from a neutral potential to a first potential of a first polarity, a second section, after the completion of said first section, in which a potential of the other electrode of each of said electrode pairs transfers from the neutral potential to a second potential of a second polarity opposite to said first polarity, a third section, after the completion of said second section, in which said potential of said one electrode stays at said first potential of said first polarity and said potential of said other electrode stays at said second potential of said second polarity for a predetermined period, a fourth section, after the completion of said third section, in which the potential of said other electrode transfers from said second potential of said second polarity to said neutral potential, and a fifth section, after the completion of said fourth section, in which said potential of said one electrode transfers from said first potential of said first polarity to said neutral potential.

Next, the manner of the sustain step in the embodiment of the present invention will be described with reference to the circuit diagram of FIG. 4 and also the time chart of FIG. 8.

It should be noted that the switching elements contained in the circuit in FIG. 4 may be configured, for example, using a FET drain terminal and source terminal, or they may be configured using other semiconductor elements. Incidentally, when using a FET, ON-OFF control for the switching element is achieved by applying a control signal to the gate terminal of the FET.

Furthermore, the ON-OFF condition of all the switching elements shown in FIG. 4 is controlled with control signals that are supplied from the drive control circuit 51 shown in FIG. 3. However, in the time chart shown in FIG. 8, the various control signals supplied from the drive control circuit 51 are omitted in order to clarify the description, with simply only the changes in the ON-OFF condition of each switching element shown chronologically.

It should be noted that in the following description, the name of each switching element is noted with only its reference name, as in U1XS for example. Likewise, other elements such as capacitors and inductors are also indicated only by their reference names, as in C1 and U1XL for example.

Figure 8:
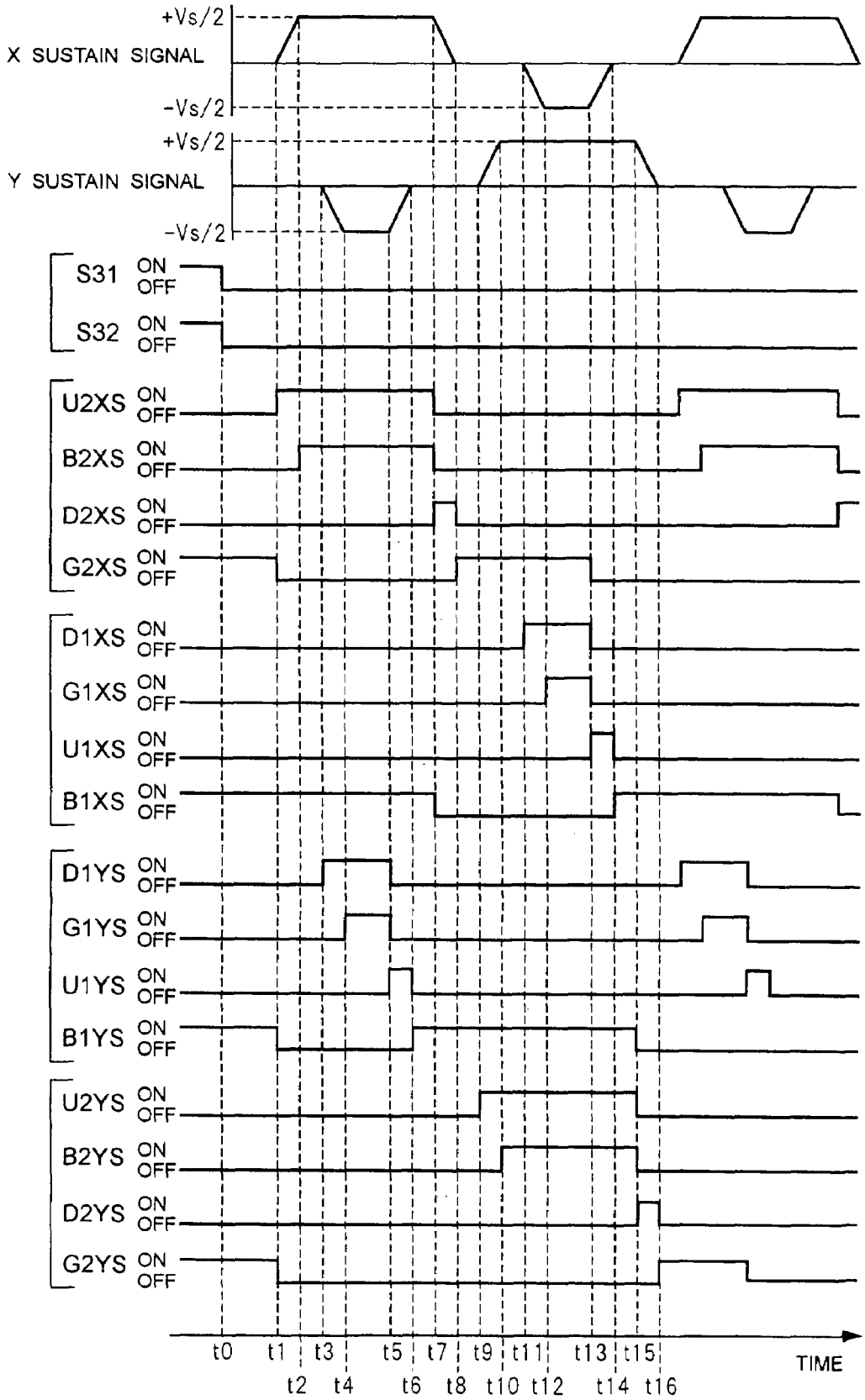
FIG. 8 is a time chart that illustrates the stages of sustain pulse generation in the circuit shown in FIG. 4.

First, generation of the X sustain signal shown in the time chart of FIG. 8 is described.

At the time-point t0 in FIG. 8, the S31 and the S32 of the row electrode drive circuit 21 are turned OFF, and the Z11 connected to the Z electrode of the discharge cell is in a state of high impedance.

Next, at the time-point t1, the U2XS of the row electrode drive circuit 41 (the X electrode drive circuit) is turned ON and the G2XS is turned OFF, so that the C4 is connected via the serial branch U2X to the X11, which is the output terminal to the X electrode. The C4 is charged in advance by a means (not shown in the drawings) to a predetermined electric potential, and this charging current flows via the resonance circuit U2X into the capacitance component of the discharge cell connected to the X electrode, so that the electric potential of the X electrode begins to increase due to the resonance current. After this, since the B2XS is turned ON at the time-point t2, the electric potential of the X electrode is clamped at the electric potential of the T5 (+Vs/2).

After this, at the time-point t7, the U2XS and the B2XS are turned OFF and the D2XS is turned ON, releasing the clamping of the X electrode, and now the serial branch D2X is connected to the X electrode instead of the serial branch U2X. In this way, the charge that is charged to the capacitance component of the discharge cell is now discharged via the resonance circuit D2X to the C4, and the electric potential of the X electrode gradually decreases. After this, at the time-point t8, the D2XS is turned OFF and the G2XS is turned ON, and therefore the serial branch D2X is disconnected from the X electrode so that the electric potential of the X electrode is clamped to the ground potential via the G2XD.

Next, at the time-point t11, the D1XS is turned ON and the C3 is connected via the serial branch D1X to the X electrode.

Since the C3 is charged in advance by a means (not shown in the drawings) to a predetermined negative electric potential, the electric potential of the X electrode is gradually reduced by the resonance current via the resonance circuit D1X. After this, at the time-point t12, the G1XS is turned ON so that the electric potential of the X electrode is clamped to the electric potential of the T6 (−Vs/2).

After this, at the time-point t13, the D1XS and the G1XS are turned OFF and the U1XS is turned ON, releasing the clamping of the X electrode, and now the C3 is connected to the X electrode via the serial branch U1X instead of the serial branch D1X. In this way, the electric potential of the X electrode gradually increases due to the power collection of the resonance circuit U1X and the C3.

Then, at the time-point t14, the U1XS is turned OFF and the B1XS is turned ON so that the serial branch U1X is disconnected from the X electrode and the electric potential of the X electrode is clamped to the ground potential via the B1XD.

The voltage waveform of one cycle portion of the X sustain signal shown in FIG. 8 is generated by the above-described operation.

Next, generation of the Y sustain signal is described. It should be noted that the sustain signals to the Y electrode are supplied to the output terminal Y11 via the connecting line Y12 and a reset pulse-scanning pulse generating portion, but the operation of this portion has no direct relation to the present invention. Accordingly, the operation of this portion is omitted in the following description and description is given with the assumption that the connecting line Y12 is the output terminal to the Y electrode.

First, as in the case of the X sustain signal, at the time-point t0 shown in the time chart in FIG. 8, the S31 and the S32 of the row electrode drive circuit 21 are turned OFF, and the Z electrode of the discharge cell is in a floating state.

Next, at the time-point t1, the B1YS of the row electrode drive circuit 31 (the Y electrode drive circuit) is turned OFF to release the clamping to the ground potential of the Y12. After this, at the time-point t3, the DLYS is turned ON and the C1 is connected via the serial branch D1Y to the Y12. Since the C1 is charged in advance by a means (not shown in the drawings) to a predetermined negative electric potential, the electric potential of the Y12 is gradually reduced by the resonance current via the resonance circuit D1Y. After this, at the time-point t4, the G1YS is turned ON so that the electric potential of the Y12 is clamped to the electric potential of the T2 (−Vs/2).

After this, at the time-point t5, the D1YS and the G1YS are turned OFF and the U1YS is turned ON, releasing the clamping of the Y12, and now the C1 is connected to the Y12 via serial branch U1Y instead of the serial branch D1Y. In this way, the electric potential of the Y12 gradually increases due to the power collection of the resonance circuit U1Y and the C1.

Then, at the time-point t6, the U1YS is turned OFF and the B1YS is turned ON so that the serial branch U1Y is disconnected from the Y12 and the electric potential of the Y12 is clamped to the ground potential via the B1YD.

Next, at the time-point t9, the U2YS is turned ON and the C2 is connected via the serial branch U2Y to the Y12. The C2 is charged in advance by a means (not shown in the drawings) to a predetermined electric potential, and this charging current flows via the resonance circuit U2Y into the capacitance component of the discharge cell connected to the Y electrode, so that the electric potential of the Y electrode begins to increase due to the resonance current. After this, since the B2YS is turned ON at the time-point t10, the electric potential of the Y12 is clamped to the electric potential of the T1 (+Vs/2).

After this, at the time-point t15, the U2YS and the B2YS are turned OFF and the D2YS is turned ON, releasing the clamping of the Y12, and now the serial branch D2Y is connected to the Y12 instead of the serial branch U2Y. In this way, the current that is charged to the capacitance component of the discharge cell is now discharged via the resonance circuit D2Y to the C2, and the electric potential of the Y electrode gradually decreases. After this, at the time-point t16, the D2YS is turned OFF and the G2YS is turned ON, and therefore the serial branch D2Y is disconnected from the Y12 so that the electric potential of the Y electrode is clamped to the ground potential via the G2YD. Thus, as shown in FIG. 8, the voltage waveform of one cycle portion of the Y sustain signal is generated.

The above-described operation is repetitively executed during the period of the sustain step in the drive circuit shown in FIG. 4, and in this way the sustain signal shown in FIG. 8 appears cyclically in the X and Y electrodes of the discharge cell.

As described above, with the present invention, the output terminal of the column electrode drive circuit can be maintained in a state of high impedance during the entire period of the sustain step, and the capacitance load of the discharge cells can be reduced, and it is therefore possible to reduce power consumption in the sustain step.

It should be noted that the description above uses an example of a display panel driving sequence in which:

(1) A wall charge is temporarily formed in all the discharge cells of the display panel by a reset discharge in the reset step;

(2) Subsequently, the wall charges in a portion of the discharge cells are selectively erased by a selective erasure discharge in the addressing step to set the light-emitting state or non-light-emitting state of each discharge cell.

However, the present invention is not limited to this embodiment. A display panel driving method according to the present invention may also be applied, for example, to a driving sequence in which all the discharge cells are initialized to a non-light-emitting state by a reset discharge, after which wall charges are selectively formed in the addressing step by a selective writing discharge to set the light-emitting state or non-light-emitting state of each discharge cell.

This application is based on Japanese Patent Application No. 2003-112530 which is herein incorporated by reference.

What is claimed is:

1. A display panel driving method for driving a display panel, the display panel including a plurality of row electrode pairs, a plurality of column electrodes arranged intersecting the plurality of row electrode pairs, and capacitive light-emitting elements arranged at intersecting points of the row electrode pairs and the column electrodes, and in which driving is performed by repeating a driving step that comprises a reset step, an addressing step, and a sustain step, wherein:

an output terminal of a column electrode drive circuit connected to the column electrodes is connected to a switch having a parasitic diode, and during the period of the sustain step, said output terminal of said column electrode drive circuit is maintained in a high impedance state, and bipolar pulse signals which are a half cycle out of phase with each other are supplied to each of a first row electrode and a second row electrode that constitute each of the row electrode pairs, wherein a period exists wherein a negative polarity pulse and a positive polarity pulse respectively of said bipolar pulse signals are simultaneously applied to one electrode and the other electrode of each of said row electrode pairs respectively, and wherein a leading edge of said negative polarity pulse applied to said one electrode and a leading edge of said positive polarity pulse applied to said other electrode exist at different timings, and a trailing edge of said negative polarity pulse applied to said one electrode and a trailing edge of said positive polarity pulse applied to said other electrode exist at different timings.

2. The display panel driving method according to claim 1, wherein rising edge portions and falling edge portions of positive pulses and negative pulses contained in the bipolar pulse signals are caused by a shift in electric potential based on resonance of a resonance circuit.

3. A display panel driving method for driving a display panel, the display panel including a plurality of row electrode pairs, a plurality of column electrodes arranged intersecting the plurality of row electrode pairs, and capacitive light-emitting elements arranged at intersecting points of the row electrode pairs and the column electrodes, and in which driving is performed by repeating a driving step that comprises a reset step, an addressing step, and a sustain step, wherein:

during the period of the sustain step, an output terminal of a column electrode drive circuit connected to the row electrodes is maintained in a high impedance state, and bipolar pulse signals which are a half cycle out of phase with each other are supplied to each of a first row electrode and a second row electrode that constitute each of the row electrode pairs, wherein said period of said sustain step includes a first section in which a potential of one electrode of each of said electrode pairs transfers from a neutral potential to a first potential of a first polarity, a second section, after the completion of said first section, in which a potential of the other electrode of each of said electrode pairs transfers from the neutral potential to a second potential of a second polarity opposite to said first polarity, a third section, after the completion of said second section, in which said potential of said one electrode stays at said first potential of said first polarity and said potential of said other electrode stays at said second potential of said second polarity for a predetermined period, a fourth section, after the completion of said third section, in which the potential of said other electrode transfers from said second potential of said second polarity to said neutral potential, and a fifth section, after the completion of said fourth section, in which said potential of said one electrode transfers from said first potential of said first polarity to said neutral potential.

4. The display panel driving method according to claim 3, wherein rising edge portions and falling edge portions of positive pulses and negative pulses contained in the bipolar pulse signals are caused by a shift in electric potential based on resonance of a resonance circuit.

* * * * *